US007298229B1

(12) United States Patent
Ruelke

(10) Patent No.: US 7,298,229 B1
(45) Date of Patent: Nov. 20, 2007

(54) MULTI-LAYERED INDUCTIVELY COUPLED HELICAL DIRECTIONAL COUPLER

(75) Inventor: Charles R. Ruelke, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/307,443

(22) Filed: May 10, 1999

(51) Int. Cl.
*H01P 1/18* (2006.01)

(52) U.S. Cl. ..... 333/116; 333/117

(58) Field of Classification Search ..... 333/109, 333/112, 115, 116, 117
See application file for complete search history.

(56) References Cited

U.S. PATENT DOCUMENTS 2,794,958 A * 6/1957 Peter ..... 333/115
4,532,484 A * 7/1985 Tajima et al. ..... 333/116
5,281,929 A * 1/1994 Willems ..... 333/116
5,907,266 A * 5/1999 Budka et al. ..... 333/116

* cited by examiner

*Primary Examiner*—Benny Lee

(57) ABSTRACT

A coupling device in FIG. 3 consisting of upper and lower connecting plates 100 and 101 with external flanges parallel to transmission line (103) for coupling RF energy for forward power detection. The coupling device (100) incorporates a helix structure with rotation centered near or about transmission line 103 and incorporates embedded secondary structures which are parallel to transmission line and fixed a predetermined distance from the transmission line (103). Theses plurality of parallel flanges are used to increase the coupling coefficient and directivity of the helix coupler (107) and maintain geometries that optimize magnetic field coupling. One or more vias (102) are used to connect individual upper connecting plate (100) and individual lower connecting plate (101) to form the overall helix structure. The addition of the parallel flanges to upper and lower connecting plates allow for a greater coupling efficiency per unit length of transmission line 103.

14 Claims, 7 Drawing Sheets

MULTI-LAYERED INDUCTIVELY COUPLED HELICAL DIRECTIONAL COUPLER

TECHNICAL FIELD

This invention relates in general to two-way radios and more particularly to RF power coupling.

BACKGROUND

Radio Frequency (RF) Coupling networks are well known in the art and are used in many different applications. These applications include transmit power control, radar detection and control, isolation and feedback strategies. Particular to the portable radio, coupler designs are critical to optimizing transmit output power while providing protection to the transmit power amplifier. A properly designed coupler will provide differentiation between incident and reflected RF energy (directivity) while exhibiting uniform coupling efficiency over the desired RF frequency range. The physical design of the coupler must accommodate well understood relationships between RF voltage potentials and their associated electric fields, and RF current densities and its associated magnetic fields. Both magnetic (H-field) and electric fields (E-field) are present in a propagating RF signal; however, the coupler's physical design can be constructed to primarily operate off either field (electric or magnetic) as the fundamental coupling mechanism. The relationship between the two fields are defined by a family equations known as Maxwell's equations. The electromagnetic vector relationships germane to this discussion are shown in Table 1 below:

TABLE 1

| | | |
|---|---|---|
| | | $S = E \times H$ |
| where | S = | Power per unit area (W/m^2)-Poynting Vector |
| | E = | Electric Field Intensity Vector |
| | H = | Magnetic Field Intensity Vector |
| | | and |
| | | $V \times H = J + \partial D/\partial t$; |
| where | V = | Direction of the axis of rotation and the magnitude of the rotation Vector |
| | H = | Magnetic Field Intensity Vector |
| | J = | Current Density Vector |
| | D = | Magnetic Flux Density |
| | $\partial/\partial t$ = | time derivative |

From Maxwell's equations, it is shown that a time varying electric and magnetic field generated by RF current densities or voltage potentials applied to a transmission line induce electromagnetic (EM) fields in the surrounding region. If a second conductor is positioned within the region, the magnetic field (H-field) will induce a current vector J proportional to the conductor's surface area which is perpendicular to propagating EM fields The vector direction of the induced field is determined by the Poynting Vector S. This principle holds true for both coplanar and offset structures that are positioned on different planes from the main transmission line. By using the "Right Hand Rule" to S, the direction of the current flow within a given conductor can be determined by rotating the index finger of the right hand from the E-field vector to the H-field vector, and noting that the extended thumb points in the direction of the current flow. A diagram of a transmission line with a coupling structure positioned in an upper plane (not directly over) the main transmission line is shown in FIG. 1.

Prior art FIG. 1 shows the top surface of the transmission line 101 exhibits a magnetic field polarity that is "additive" to the H-field of the lower surface Upper Plate 100 (coupling structure). For this condition to exists, the induced current "$i_o$" in the upper plate 100 must flow in the OPPOSITE direction of the current "$i_1$" in transmission line 101. If the plate current were "forced" to flow in the same direction as the transmission line current, the H-fields between the transmission line and the plate would tend to "cancel" each other and coupling efficiency would be degraded. Thus, any geometry that enhances the coupler structure performance based on magnetic field coupling must provide complementary magnetic fields with the same polarity as that distributed on the transmission line.

It is also apparent from FIG. 1 that E-fields are perpendicular to the H-field. Thus, for the E-fields to couple efficiently, the coupling structure should "overlap" the transmission line to maximize the conductor surface area which is perpendicular to the E-fields. This method of coupling can be described as Capacitive coupling (or broad edge coupling). This is different from a structure that utilizes magnetic field coupling, since maximizing perpendicular surface area to the H-field only requires a parallel structure to the transmission line, it does not necessitate overlap. These principles hold true for any three-dimensional (3-D) structure, including those which may be embedded into a PC board.

FIG. 2 illustrates a 3-D multi-plane coupling structure of the prior art with the associated upper and lower coupling plates 200 and 202 with current vectors ("$i_o$" and "$i_2$", respectively). The coupling plates 200 and 202 have an H-field generated by RF current "$i_i$" propagating along transmission line 201 that induces H-fields of like polarity on coupling plates 200 and 202 for the surface facing the transmission. In other words, the H-field for the lower side of upper plate 200 is vectored the same as the top side of transmission line 201, and the H field for the top side of lower plate 202 is vectored the same as the lower surface of transmission line 201. These time varying magnetic fields generate current vectors $i_o$ and $i_2$ respectively. It is important to note that the H-field polarity of the lower surface of upper plate 200 CONFLICTS with the top surface polarity of lower plate 202. Thus, regions where the upper and lower plate overlap will cause reduced coupling efficiency, due to H-field cancellation, if they are electrically connected together (i.e. Current flows in the same direction in both structures). It is therefore imperative that the multi-layered helical geometry minimize regions of overlap between differing planes having current vectors oriented in the same direction.

From the foregoing discussion, it is evident that the two fields (E-field and H-field) are complementary, but independent mechanisms that can be used to provide coupling of RF energy. The electromagnetic relationship between them is determined by Maxwell's equations, which form guidelines that must be met to maximize coupling efficiency while providing superior directivity.

Directivity is a measure of the reflected and incident field differentiation of a coupler. The algebraic difference in decibels (dB) of the forward and reverse coupling coefficients for any fixed structure is defined as the directivity of that structure. A 20 dB directivity factor is considered acceptable for a bi-directional coupler. Historically, high performance bi-directional couplers have been fabricated on a substrate such as alumina, with thin film processes and their tight tolerance capability defining the coupler geometries to achieve a controlled 20 dB coupling coefficient with greater than 20 dB of directivity. Although the modularized approach to implementing the coupler is effective, it adds cost and process steps that could otherwise be eliminated if the coupler were to be embedded into the printed circuit board (PCB). To achieve high reliability coupler performance with existing PCB make tolerances of ±2 mil gaussian width distributions requires an innovative design approach. This innovation is based on selecting the proper coupling mode (E-field or H-field) that provides a design meeting manufacturing and performance requirements, while minimizing cost and area. Therefore, the need exists for embedded PCB coupler structure which achieves these desired objectives.

DETAILED DESCRIPTION OF THE PREFERRED EMBODIMENT

The focus of this discussion is to detail a methodology of magnetic field coupling and the associated geometric constraints. A summary of the electrical constraints that maximize magnetic field coupling is listed below.

1) The maximally efficient inductive structure is a closely wound helical geometry where H-fields from contiguous windings are additive. This structure provides the smallest-(most spatially efficient) three-dimensional resonant structure and can be used to induce a band pass coupling response.

2) For multi-layer planar structures, minimize H-field cancellation by minimizing overlap between coupling structures that are also electrically connected to each other.

3) Since current densities are maximal at the EDGES of a planar transmission line, maximum H-field coupling and directivity performances achieved by maximizing the coupling structure's EDGE surface area that runs PARALLEL to the main transmission line.

4) Ensure that overall current flow induced onto the coupling structure is not "folded back" onto itself by utilizing structures that have 180° discontinuities within the same plane.

Some of these guidelines may tend to conflict with each other (i.e.: #1 & #3 above); however, optimization for best performance is still realizable. This is achieved by adopting a helix as the basic geometric structure used in the coupler, but with sufficient space between contiguous windings to allow secondary structures to be embedded to maximize the magnetic (H-Field) coupling mode. Since planar structures are configured based on the frequency of operation, spatial requirements and desired performance for a given application, a final element of the embodiment includes series lumped element components as resonant elements. In summary, the overall concept as disclosed in this invention is:

- the implementation of unique multi-planar geometry(s) incorporating a helix topology "wrapped" around main transmission line (Helix with transmission line running down center axis), which is adaptable to being embedded into a RF PCB:
- Coupling plates embedded into helix to maximize magnetic field (inductive) mode coupling; and
- Series lumped element capacitor to achieve band pass resonant response; also serving to block direct current (DC) from the rectifying diode.

Figure 3:
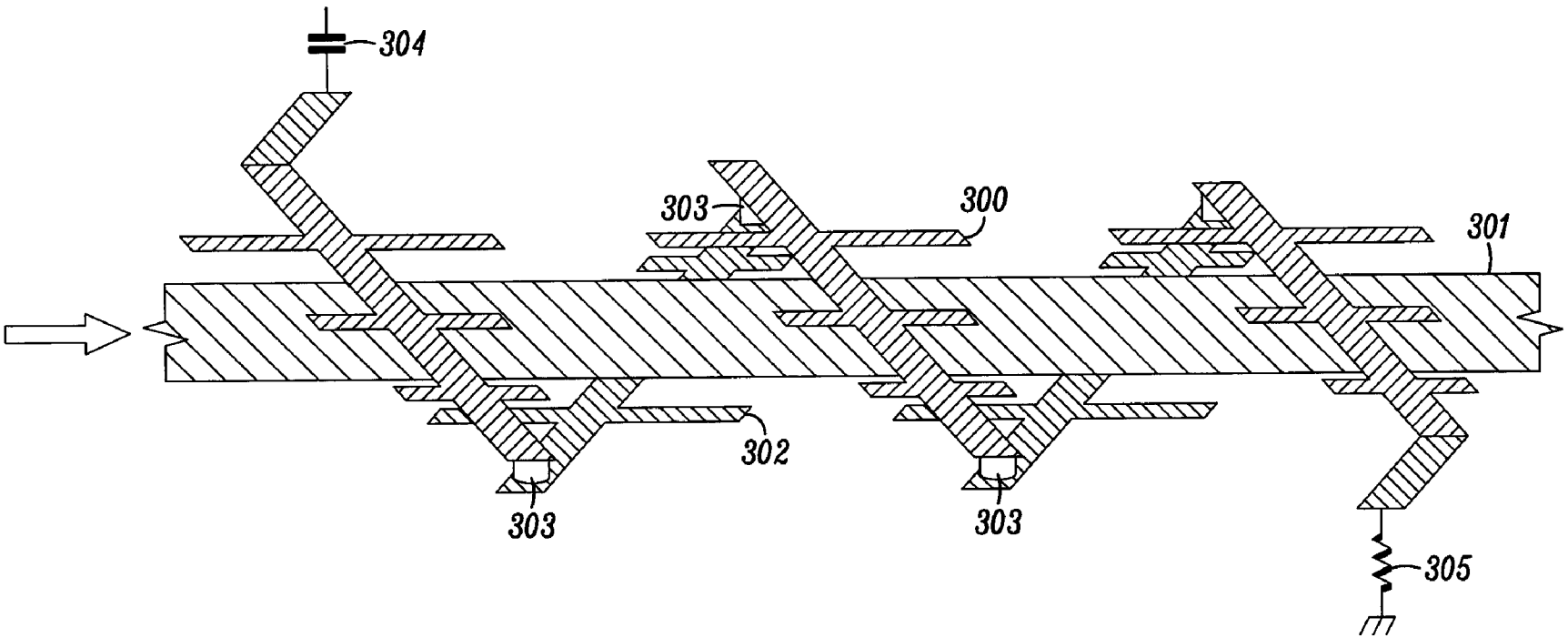
FIG. 3 is a 3-dimensional profile view of the preferred embodiment of the invention, illustrating a planar helix structure wrapped around the main transmission line with secondary coupling appendages parallel to the transmission line.
Figure 7:
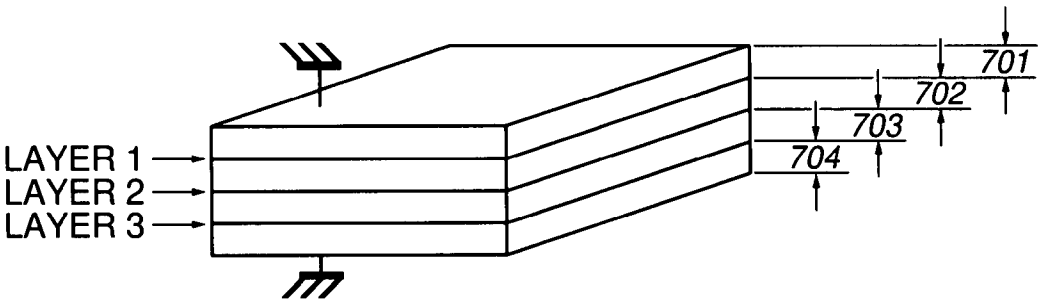
FIG. 7 is a side view of the multi-layer structure showing dielectric thickness and plane designation of the helix/structure shown in FIGS. 3 through 6 Note that dielectric thickness 701, 702, 703, and 704 may vary independently depending on the particular coupling structure topology used and the performance target.

Referring now to the preferred embodiment shown in FIG. 3, a stripline transmission line 301 is positioned along the center axis of a multi-planar helical structure comprised of upper plate 300 and lower plate structures 302 electrically connected together by a series of vias 303. Structures 300, 301, and 302 are all on different planes, each plane separated by a dielectric material with characteristic impedance and velocity factor characteristics selected for the particular RF application. FIG. 7 illustrates this planar relationship for stripline structures, with structures 300, 301, and 302 of FIG. 3 being located on Layer 1, Layer 2 and Layer 3 of FIG. 7 respectively. The ground planes (not shown) are positioned above and below the entire structure in compliance with classical stripline techniques. Note that passive elements equivalent to capacitor 304 and resistor 305 of FIG. 3 are not shown in FIG. 7. For classical microstrip transmission line designs, a single ground plane (not shown) is positioned below lower plate structures 302 and air dielectric is used above the transmission line 301; thus the upper plate structures 300 are functionally "air bridges" over transmission line 301.

Transmission line 301 is generally attached to an RF source such as an RF power amplifier (not shown) and provides for efficient propagation of RF energy within a specific frequency range to subsequent stages such as harmonic filters (also not shown). As RF power is transmitted down the main transmission line, EM near-fields are generated which are coupled to adjacent structures 300 and 302. The physical dimension of the transmission line 301 is determined through classical methods dependent on substrate dielectric constants, desired characteristic impedance, and distance from ground planes (not shown). The physical dimensions of upper and lower coupling plates 300 and 302 are set to minimize capacitive (E-field) coupling; thus overlap with either the main transmission line or with subsequent interconnected plates are minimized. This means that the coupling plated are generally thin with respect to the transmission line (high impedance) and designed to maximize surface area parallel to the main transmission line (perpendicular to the H-field) through using secondary appendages or geometric structures. The number of turns of the helix structure is set by the coupling factor and frequency of operation required for the given application. The greater the number of turns for a given frequency, the higher the coupling factor. The higher the frequency of operation, the lower the number of turns required for a given coupling factor.

The direction of the power detected for the coupler is determined by the location of the terminating impedance (for example the resistor 305 in FIG. 3). Given forward RF power is defined as propagating along the transmission line 301 from left-to-right as indicated in FIG. 3, then coupled RF energy proportional to the forward power will propagate through capacitor 304 when terminating resistor 305 is positioned as shown in FIG. 3. If the relative positions of capacitor 304 and resistor 305 is swapped, then the coupled RF energy at capacitive element 304 will be proportional to an incident wave propagating from right-to-left (Reflected or reverse power detection). For both forward and reverse power detection applications, the basic geometric constraint for the helix are the same.

As illustrated in FIG. 3, a series of vias 303 are employed to interconnect the upper and lower plates 300 and 302 to provide electrical connectivity to the entire helix coupling structure. The distance from the vias to the edge of the main transmission line is determined by the plane of intersection between the H-field and the helix structure. Although this relationship will be explored in further detail herein, it should be noted that in some alternative embodiment geometries, the via connection 303 can be considered perpendicular "flanges" in the Z-plane to the H-field vectors in the XY-plane (vias 303 perpendicular to H-field of transmission line 301). This will be explored further in subsequent descriptions.

In general, all multi-layered helix structures must be interconnected to form the proper geometry, which in turn must be attached to a terminating impedance and to a series capacitive element (lump or distributed) as shown in FIG. 3. The frequency response of the coupler is determined by the intrinsic inductance of the helix, and the series lump element capacitor. Directivity is "peak" in the frequency band of operation, providing optimum performance. The series capacitor also may serve as a dc block capacitor for external transmitter circuits that require a particular bias.

Figure 4:
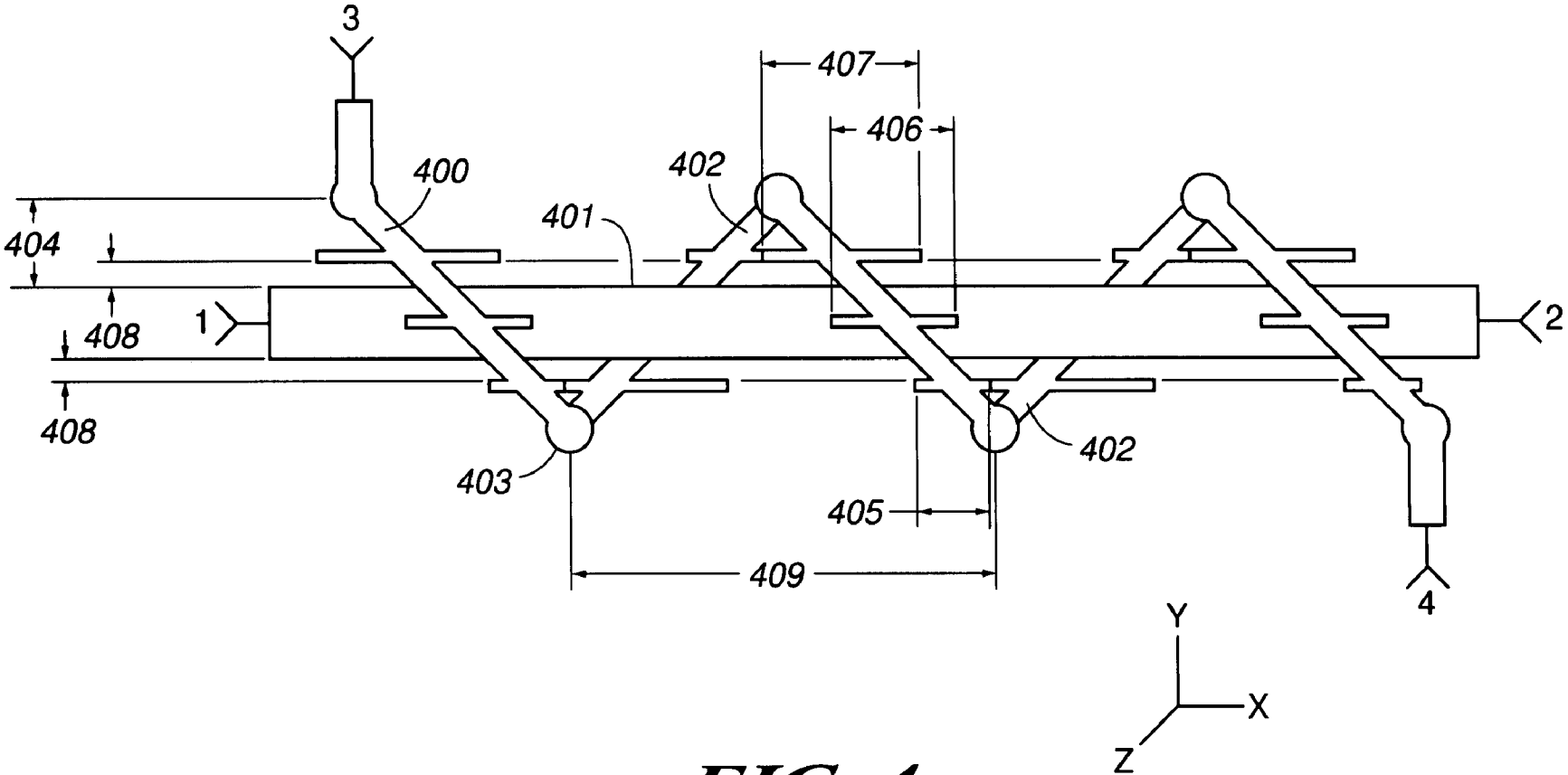
FIG. 4 is a top view of helix structure of FIG. 3 (YAG Structure) with ports 1, 2, 3, and 4 designating inter circuit connections. Three dimensional axis designation X, Y and Z are also indicated with the Z plane bisecting the page.

Referring to FIG. 4, the interrelationship between the helix structure, secondary flanges, and main transmission line 401 can be clearly seen. This top view of FIG. 3 shows that the horizontal separation 408 between the flange edge and the transmission line 401 is minimal without overlapping each other. The distance 404 from the transmission line edge to vias 403 is significantly larger than flange separation 408. And since near field coupling efficiency is inversely proportional to the distance between the source (transmission line 401) and receptor, the flanges embedded into the upper and lower plates 400 and 402 are the primary coupling structure over the vias. The flange segment lengths 405, 406, and 407 are determined by geometric spacing of the interconnecting vias 409 and the frequency of operation.

It should be noted that in this embodiment, the flanges are variable length to maximize coupling bandwidth and that the upper and lower plate flanges do not overlap each other. It will be evident to those skilled in the art, that variable number of flanges (greater than one) can be used and the flange length 405, 406, and 407 can be varied from this embodiment and still functionally maintain the integrity of the helix structure. The dielectric thickness between the planes containing lower plates 402, transmission line 401 and upper plates 400 are determined by standard PCB manufacturing process and desired coupling efficiency, understanding that thinner dielectric thickness (closer proximity between transmission line and coupling plates) increase coupling efficiency for reasons previously discussed. The illustration of the multi-layered structure is shown in FIG. 7. This coupling structure provides H-field coupling in the XY plane primarily through the flange extensions. As previously discussed, capacitive and resistive terminations may be positioned at terminals 3 and 4 to functionally differentiate the direction (incident or reflected) of the RF energy being conducted on transmission line 401.

Figure 5:
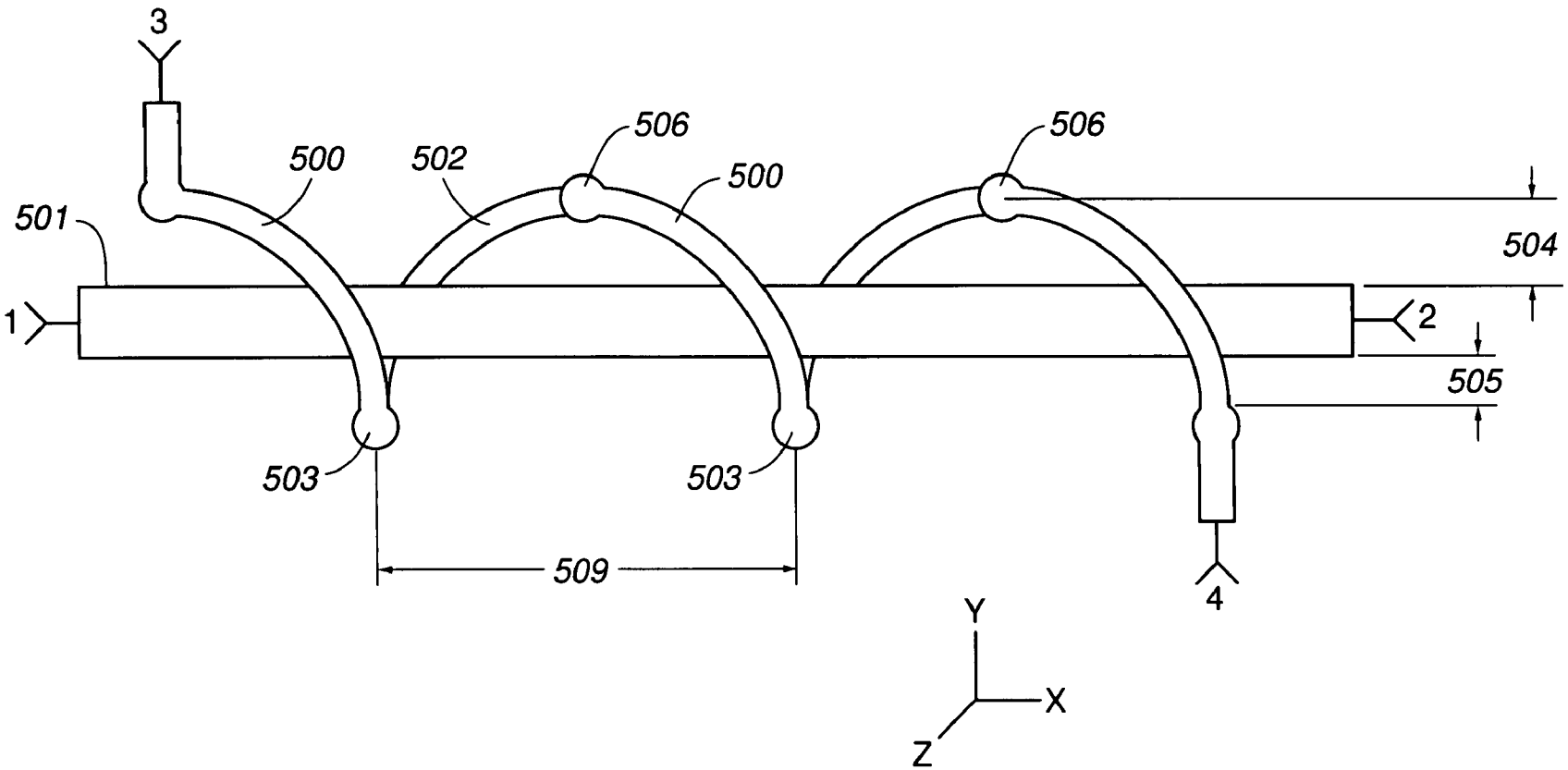
FIG. 5 is a top view of a helix structure with parallel structure within the Z plane at vias. (C Structure) with ports 1, 2, 3, and 4 designating inter circuit connections. Three dimensional axis designation X, Y and Z are also indicated with the Z plane bisecting the page.

Referring to FIG. 5, a second or alternative embodiment of the invention is disclosed. Here, no parallel structures are evident in the XY plane between transmission line 501 and upper and lower plate structures 500 and 502. However, the transmission line 501 is offset to one side to provide close proximity to the family of vias 504. Distance 505 is significantly smaller than distance 504 (proximity to family of vias 506). Thus the H-field radiation in the XY plane is perpendicularly bisected by vias 503 in the Z-plane. Distance 505 is set by PCB manufacturing tolerances and the desired level of coupling efficiency required for the given application. The geometry in FIG. 5 has a further advantage of minimizing capacitive coupling by minimizing the overlap surface area between coupling plates 500 and 502 and transmission line 501. The distance 509 between each via is determined by the desired arch-length of the interconnecting coupling plates 500 and 502, and the desired coupling coefficient. The greater the number of vias per unit length of transmission line 501, the higher the coupling factor.

Figure 1:
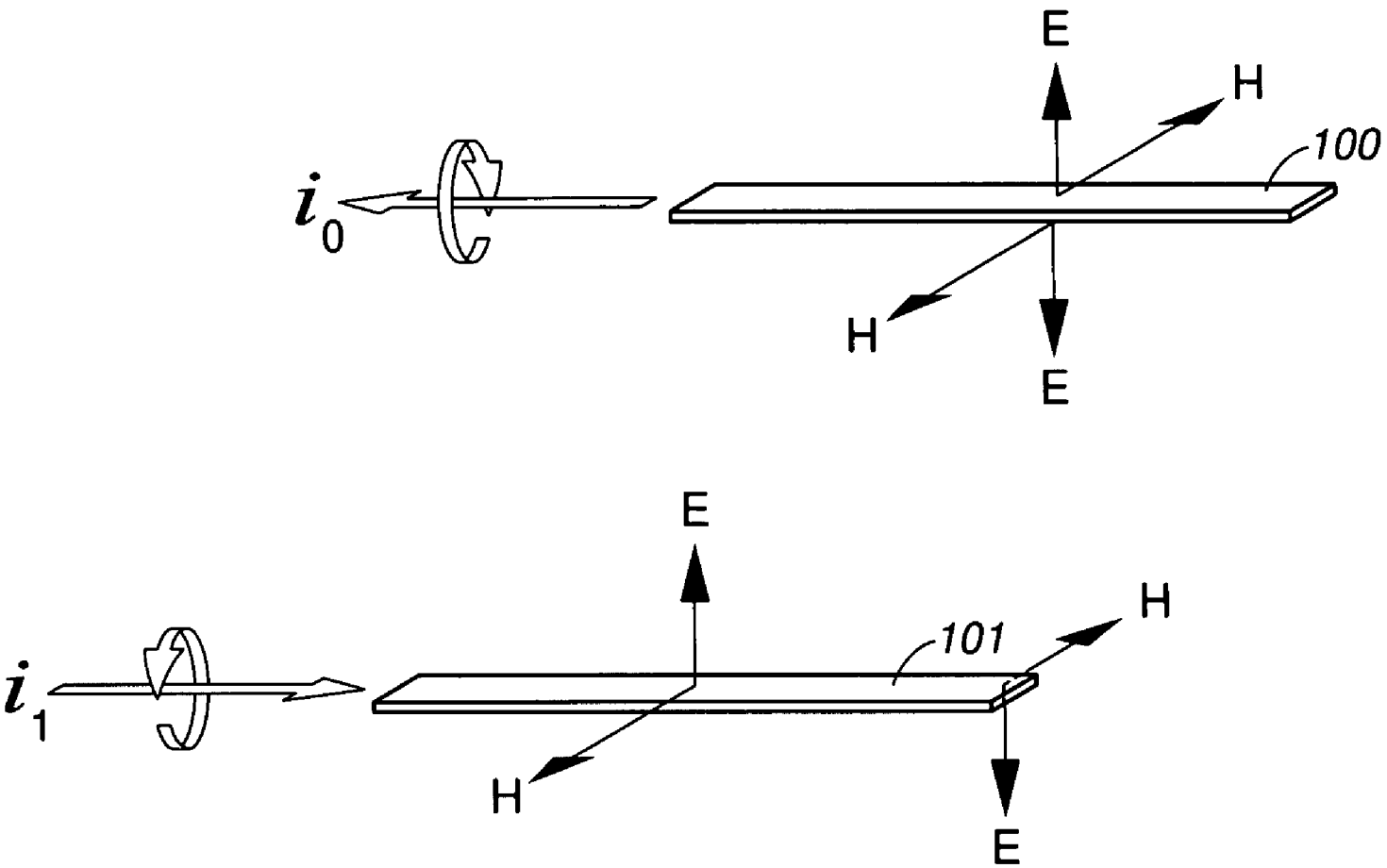
FIG. 1 (PRIOR ART)
FIG. 1 is a profile view of magnetic & electric field polarities for single plate coupler structure & main transmission line used in the prior art.
Figure 2:
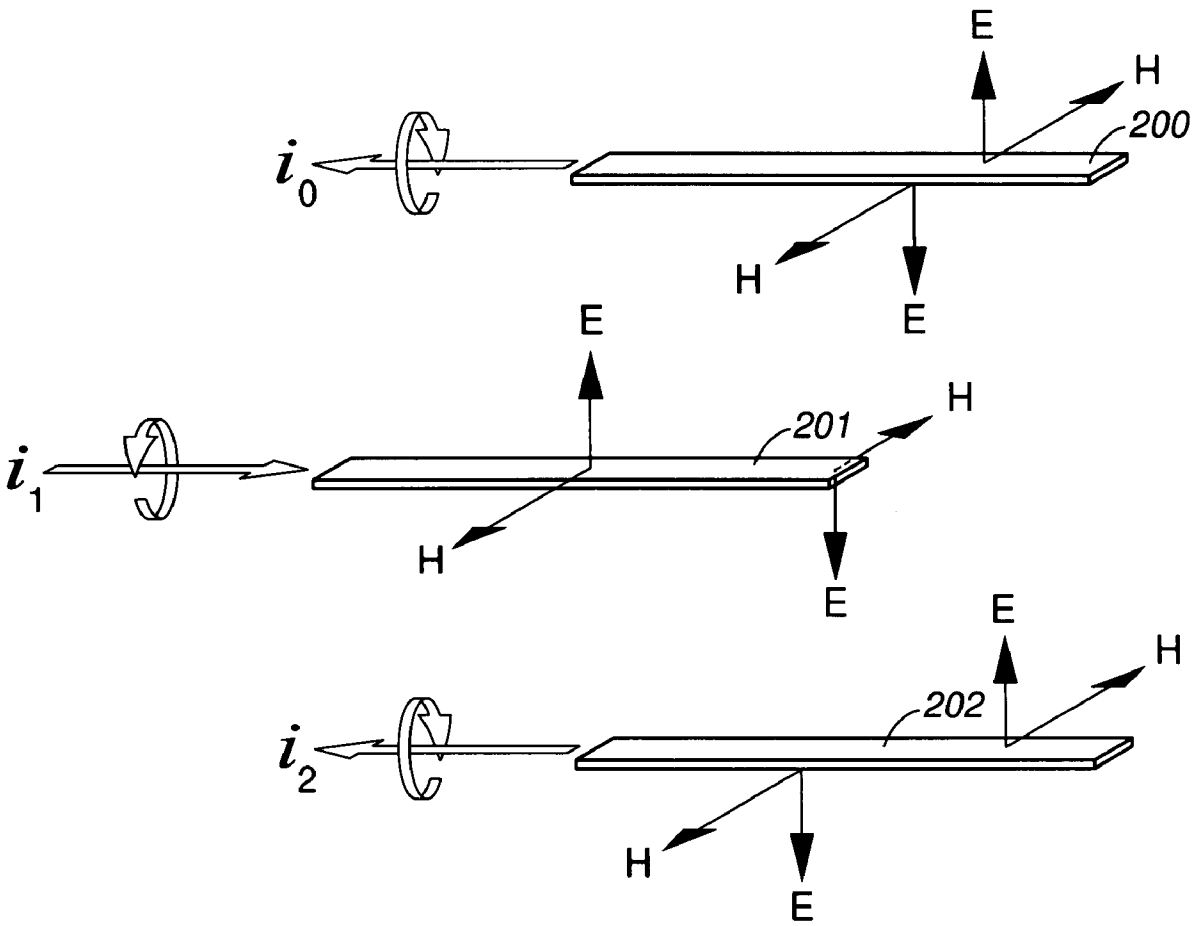
FIG. 2 (PRIOR ART)
FIG. 2 is a profile view of magnetic & electric field polarities for multi-plane coupler structure & main transmission line used in the prior art.

It should be further noted that distance 504 should be large compared to distance 505, to avoid degradation of coupling efficiency and directivity. This degradation results from opposing H-Field induce in the upper and lower plate 500 and 502 that meet at via connection 506. As distance 504 is reduced, the upper and lower plate region at vias 506 tend to become parallel to transmission line 501, increasing the current density J induced on each plate by the H-Field. However, the H-field vector at the bottom of upper plate 500 opposes the H-field vector at the top lower plate 502. These two opposing fields are electrically connected together at via 506, thereby reducing the coupling efficiency. This is clearly illustrated in FIG. 2 while visualizing the upper and lower plates 200 and 202 connected end-to-end through a series of vias. This condition does not exist at via connections 503, as the upper and lower plate H-fields are additive, and are also located at the point of highest current density (closest proximity to transmission line 501).

Figure 6:
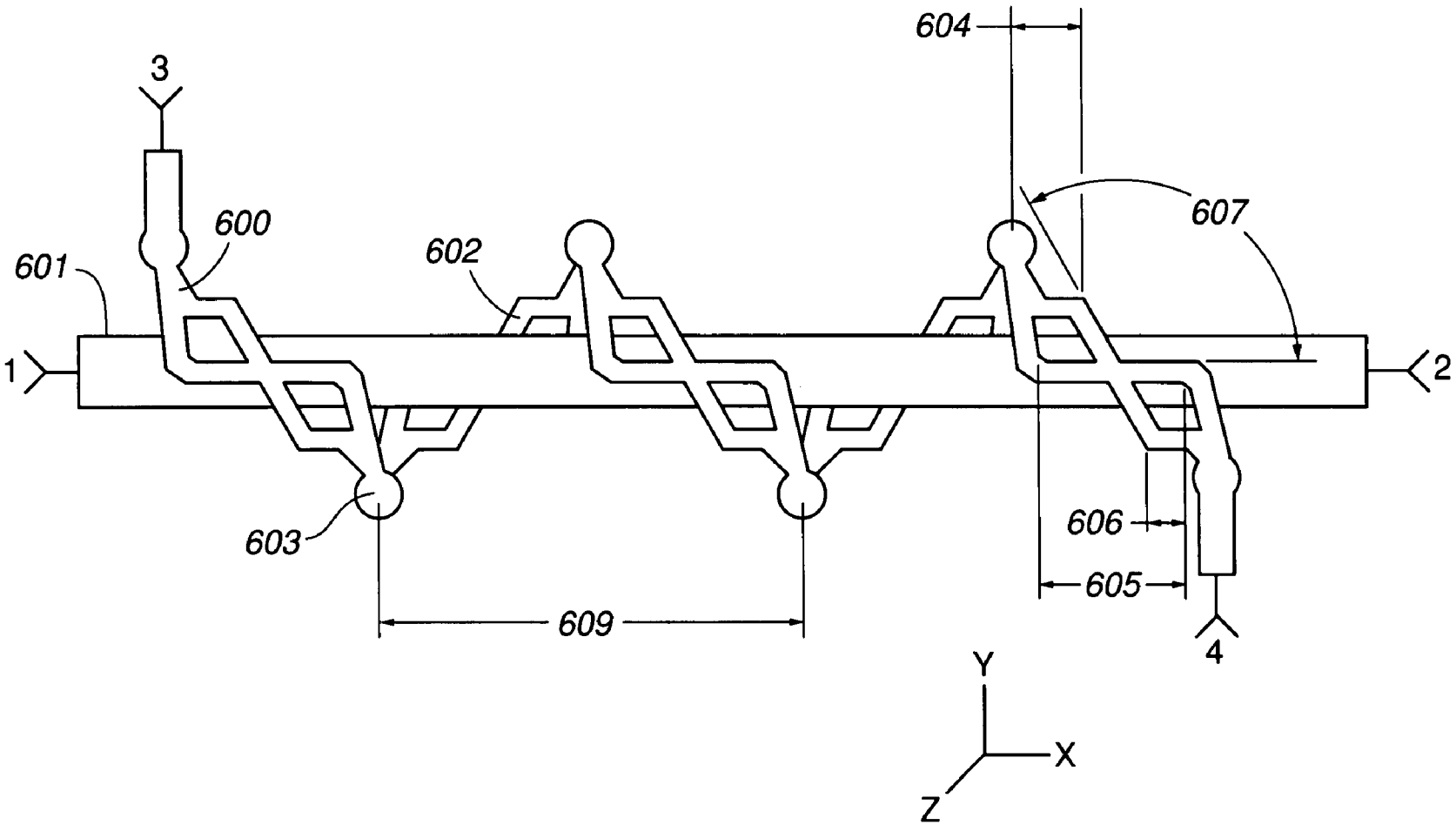
FIG. 6 is a top view of a second embodiment of the invention maximizing parallel coupling surface area within the XY plane embedded within a multi layered Helix structure. (BOW Structure) with ports 1, 2, 3, and 4 designating inter circuit connections. Three dimensional axis designation X, Y and Z are also indicated with the Z plane bisecting the page.

In yet another embodiment shown in FIG. 6, a coupling structure contains flange structures "embedded" into the upper and lower plates 600 and 602. FIG. 6 illustrates a helix coupler that bisects the H-field in the XY plane utilizing unique plate geometries to provide maximal surface area parallel to the transmission line 601 (orthogonal to the H-field). As in the previous embodiments, the upper and lower plates are interconnected through vias 603 so as to create a overall helix structure around the main transmission line 601. This coupler design is a variation of the previously discussed "yag coupler" shown in FIG. 4. The modification in this embodiment eliminates the "open stub" effect in the Yag-coupler, which creates high voltage densities at the open end of the flange with no connectivity to provide for current flow. By minimizing the open stub in the coupler structure, the overall coupler resistivity as seen by the induced current is reduced. This improves coupling efficiency and directivity of the coupler structure.

As in the previous embodiments, the distance 609 between vias is determined by manufacturing tolerances, desired coupling efficiency, and frequency of operation (which sets the number of turns in the helix). The width of transmission line 601 is determined using classical stripline or transmission line calculations dependent on substrate dielectric constant, desired characteristic impedance, and distance to nearest ground planes. The substrate geometry is equivalent to the previously discussed embodiments and is illustrated in FIG. 7. The length 604, 605 and 606 of each parallel segment embedded within the upper and lower plates 600 and 602 is set by via separation 609 and angle of intersection 607. It should be apparent to those skilled in the art that variations of the plate geometry can be achieved that changing the relative angle of 607 so that the lengths 604, 605 and 606 are varied, while still maintaining the integrity of the proposed embodiment.

Figure 8:
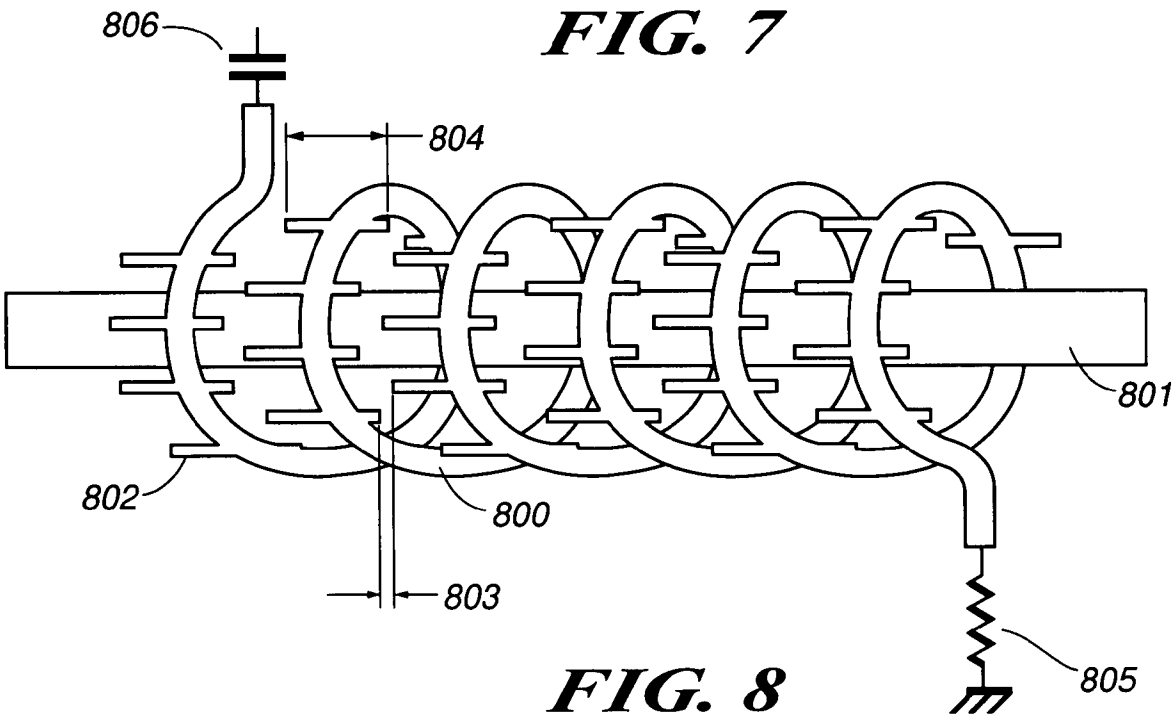
FIG. 8 is a 3-dimensional profile view of yet another embodiment of the invention, illustrating a continuous helix structure wrapped around the main transmission line with secondary coupling elements parallel to the transmission line.

Another possible embodiment of this invention is applicable to non-planar structures. Referring to FIG. 8, a transmission line or wire 801 is suspended in a dielectric such as air. A semi-rigid, continuous helix structure 800 is wrapped around transmission line 801 to support secondary coupling element 802. These coupling elements are parallel to the transmission line and may be of varying lengths 804, varying quantity, or separation 803, depending on the application, frequency of operation, or desired performance. The coupling elements 802 are connected together through helix structure 800, which is electrically conducting. Termination elements such as capacitor 806 and resistor 805 are positioned at the terminals of the helix to provide directional differentiation of the RF energy traveling along transmission line 801. This is similar to the techniques described in the previous embodiments.

While the preferred embodiments of the invention have been illustrated and described, it will be clear that the invention is not so limited. Numerous modifications incorporating combinations of the disclosed embodiments, changes, or variations, substitutions and equivalents of other geometries will occur to those skilled in the art without departing from the spirit and scope of the present invention as defined by the appended claims.

What is claimed is:

1. A device for coupling RF energy from a transmission line to a plurality of couplers comprising:

at least one transmission line for carrying energy from a radio frequency (RF) source;

a plurality of interconnecting upper plates distributed above the at least one transmission line whose dimension extends laterally beyond the width of the at least one transmission line;

a plurality of interconnecting lower plates distributed below the transmission line whose dimension extends laterally beyond the width of the at least one transmission line;

a plurality of vias positioned to sequentially connect an end of individual upper plates to individual lower plates so as to provide a helix structure centered around the at least one transmission line;

a plurality of secondary plates embedded into the helix structure which are parallel to the at least one transmission line;

at least one capacitive element electrically connected to one end of said helix structure;

at least one resistive element electrically connected to an opposite end of the helix structure from the at least one capacitive element; and a ground layer positioned below the plurality of interconnecting lower plates and above the plurality of interconnecting upper plates.

2. A multi-element directional coupler used with a multilayer printed circuit board comprising:

a first coupling structure connected to a radio frequency source;

a plurality of second coupling structures positioned above the first coupling structure;

a plurality of third coupling structures positioned below the first coupling structure;

a plurality of vias for connecting individual segments of the plurality of second coupling structures with individual segments of the plurality of third coupling structures so as to provide a helix structure with axis of rotation centered around the first coupling structure;

a plurality of secondary plates embedded into the plurality of second coupling structures;

a plurality of secondary plates embedded into the plurality of third coupling structures;

a ground layer positioned above the plurality of second coupling structures for providing isolation; and a ground layer positioned below the plurality of third coupling for providing isolation.

3. A multi-element directional coupler according to claim 2, wherein the plurality of secondary plates embedded into the plurality of third coupling structures are positioned parallel with the first coupling structure.

4. A multi-element directional coupler according to claim 2, wherein the plurality of secondary plates embedded into the plurality of second coupling structures are positioned parallel with the first coupling structure.

5. A multi-element directional coupler according to claim 2, wherein the first coupling structure is a RF transmission line.

6. A multi-element directional coupler according to claim 5, wherein the RF transmission line is a stripline.

7. A multi-element directional coupler according claim 5, wherein the RF transmission line is a microstrip.

8. A multi-element directional coupler according to claim 2, wherein the helix structure is a forward power coupler.

9. A method of increasing the coupling coefficient of a directional coupler device which includes a transmission line and at least one magnetic field coupling structure comprising the steps of:

positioning a first interconnecting structure in a second plane parallel to and in an adjacent plane with the transmission line;

positioning a second interconnecting structure in a third plane parallel to and in an adjacent plane with the transmission line;

aligning at least one magnetic field coupling at a predetermined distance from and parallel to the transmission line;

electrically interconnecting the at least one magnetic field coupling structure with the first and second interconnecting structure; and electrically interconnecting the first and second interconnecting structure using at least one via.

10. A method as in claim 9, wherein the at least one magnetic field coupling device is a forward power coupler.

11. A method as in claim 9, wherein the at least magnetic field coupling device is a reverse power coupler.

12. A radio frequency (RF) power coupling device comprising:

at least one transmission line for conducting RF energy applied thereto;

a first plurality of upper connecting structures positioned above the at least one transmission line for providing connectivity for coupled RF energy traveling on the at least one transmission line;

a second plurality of lower connecting structures positioned below the at least one transmission line for providing connectivity for coupled RF energy applied thereto and traveling on the at least one transmission line;

a plurality of vias for connecting individual segments of the first plurality of upper connecting structures with individual segments of the second plurality of lower connecting structures so as to provide a helix geometric structure;

a first ground layer positioned above the plurality of upper connecting structures for isolating the at least one transmission line and the plurality of upper connecting structures from outside RF interference; and a second ground layer positioned below the plurality of lower connecting structures for isolating the at least one transmission line and the plurality of lower connecting structures from outside RF interference; and wherein at least one via of the plurality of vias is positioned a predetermined distance from the transmission line said predetermined distance being less than a predetermined distance of at least one other via from the transmission line for increasing coupling between the at least one transmission line and the helix structure.

13. A radio frequency power coupling device as in claim 12, wherein the at least one transmission line, the first plurality of upper connecting structures and the second plurality of lower connecting structures are planar structures.

14. A radio frequency power coupling device as in claim 12, wherein the at least one transmission line is a microstrip, the first plurality of upper connecting structures are air bridges and the second plurality of lower connecting structures are strip line.

* * * * *